United States Patent [19]

Wiedemann

[11] Patent Number: 4,650,737

[45] Date of Patent: Mar. 17, 1987

[54] ELECTROPHOTOGRAPHIC RECORDING MATERIAL CONTAINING BENZIMIDAZOLE DERIVATIVE

[75] Inventor: Wolfgang Wiedemann, Geisenheim-Johannisberg, Fed. Rep. of Germany

[73] Assignee: Hoechst Aktiengesellschaft, Frankfurt am Main, Fed. Rep. of Germany

[21] Appl. No.: 822,239

[22] Filed: Jan. 24, 1986

[30] Foreign Application Priority Data

Jan. 26, 1985 [DE] Fed. Rep. of Germany ..... 3502689

[51] Int. Cl.[4] ..... G03G 5/06; G03G 5/14

[52] U.S. Cl. ..... 430/59; 430/58; 430/76; 430/77; 430/78

[58] Field of Search ..... 430/58, 59, 76, 77, 430/78

[56] References Cited

U.S. PATENT DOCUMENTS

| | | | |
|---|---|---|---|
| 3,915,076 | 10/1975 | Gotoda . | |
| 3,973,959 | 8/1976 | Rochlitz et al. | 430/59 X |
| 3,992,205 | 11/1976 | Wiedemann | 430/58 |
| 4,153,461 | 5/1979 | Berghaeuser et al. . | |
| 4,521,504 | 3/1980 | Sakuma et al. | 430/57 |

FOREIGN PATENT DOCUMENTS

| | | | |
|---|---|---|---|
| 25891 | 8/1972 | Australia | 430/83 |
| 2929414 | 2/1981 | Fed. Rep. of Germany . | |
| 58-156940 | 9/1983 | Japan | 430/78 |
| 59-26738 | 2/1984 | Japan | 430/78 |

*Primary Examiner*—Roland E. Martin

*Attorney, Agent, or Firm*—Schwartz, Jeffery, Schwaab, Mack, Blumenthal & Evans

[57] ABSTRACT

An electrophotographic recording material comprising an electrically conductive base material, an option insulating intermediate layer, and a photoconductive double layer comprised of a charge-generating and a charge-transporting layer employs a pyrimido[5',4':5,6]-pyrido-[1,2-a]-benzimidazole transport compound, along with a binder and a dye or pigment, in the charge transporting layer, which compound is represented by the formula I (I)

wherein $R_1$ and $R_2$ are identical or different and denote hydrogen or an $R_3R_4N$ group; $R_3$ and $R_4$ are identical or different and denote ($C_1$ to $C_4$)-alkyl, hydroxy-($C_1$ to $C_4$)-alkyl, optionally ($C_1$ to $C_4$)-alkyl-substituted phenyl or benzyl, or, together with the nitrogen atoms to which they are bonded, an imidazolyl or a triazolyl group; and $R_5$ denotes a benzothiazole, a benzoxazole, a benzimidazole or a cyano group. Use of the transport compound makes it possible to adjust the photosensitivity of the recording material to different spectral regions when the material is subjected to electrostatic charging of different polarities.

13 Claims, 12 Drawing Figures

ELECTROPHOTOGRAPHIC RECORDING MATERIAL CONTAINING BENZIMIDAZOLE DERIVATIVE

BACKGROUND OF THE INVENTION

The present invention relates to an electrophotographic recording material comprising an electrically conductive base material, an optional insulating intermediate layer, and a photoconductive double layer comprised of a charge-generating and a charge-transporting layer, the latter layer comprising a pyrimido[5',4':5,6]-pyrido[1,2-a]benzimidazole derivative as transport compound, binders and dyes or pigments.

The known high-sensitivity photoconductor systems based on organic substances are predominantly present in double or multiple layer arrangements which consist, in the majority of cases, of a relatively thin layer that absorbs within the visible wavelength region and is capable of charge generation and, adjacent thereto, a thicker charge-transporting layer that is transparent to visible light.

By virtue of their layered structure and the chemical nature of the charge transport compounds, these photoconductor double layers have a high photosensitivity upon negative or, where appropriate, upon positive electrostatic charging. By choosing suitable dyes or pigments as sensitizers, it is possible to affect the spectral photosensitivity of these double layers.

Photoconductor double layers are also known in which inorganic and organic substances are combined by means of a layered structure in which conductive base materials support layers of selenium, poly-N-vinylcarbazole and selenium (see German Auslegeschrift No. 2,364,967, which corresponds to U.S. Pat. No. 3,915,076). Using such a layer it is possible to obtain sufficient photosensitivity for both polarities.

There have also been disclosed photoconductor double layers for black/red reproduction that combine a plurality of photoconductive layers and materials having different absorption regions (for example, a red-sensitive photoconductive layer having a λ greater than 600 nm, a non-red-sensitive photoconductive layer having a λ less than 600 nm and a red- and non-red-sensitive photoconductive layer), to provide positively and negatively chargeable systems which are sensitive in different spectral regions. (See German Offenlegungsschrift No. 2,938,129, which corresponds to U.S. Pat. No. 4,521,504.)

A disadvantage to such systems is their multi-layered structure, involving partly inorganic components that lead to mutual adhesion problems and need to be applied by different methods.

In German Patent Application No. P35 02 681.2 (filed Jan. 26, 1985), attention is drawn to the high photosensitivity, on positive electrostatic charging, of the described transport compounds. The photosensitivity in question is extended by self-absorption of the compound up to a wavelength of about 500 nm, and by the addition of suitable dyes that effect spectral expansion it can be further extended.

SUMMARY OF THE INVENTION

It is an object of the present invention to provide an electrophotographic recording material which comprises organic materials in a double-layer arrangement and which is highly light-sensitive, such that, when subjected to electrostatic charging of variable polarity, the recording material is sensitive in different wavelength regions.

It is also an object of the present invention to provide an electrophotographic recording material that does not suffer the above-mentioned adhesion problems which are typical of multi-layered materials in the prior art, and that can be prepared by a relatively simple, integrated method.

It is still another object of the present invention to provide the photoconductive double-layer structure possessing a photosensitivity that can be adjusted to different spectral ranges by means of sensitizers and/or pigments.

In accomplishing the foregoing objects, there has been provided, in accordance with one aspect of the present invention, an electrophotographic recording material comprising an electrically conductive support and a photoconductive double layer provided on said support, said photoconductive double layer comprising (i) a charge-generating and (ii) a charge-transporting layer containing a transport compound, a binder and a dye or pigment sensitizer, wherein said transport compound is represented by the formula I

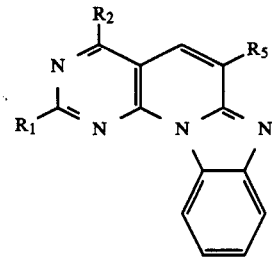

(I)

wherein $R_1$ and $R_2$ are identical or different and are each hydrogen or an $R_3R_4N$ group, $R_3$ and $R_4$ are identical or different and (1) are each (a) alkyl having 1 to 4 carbon atoms, (b) hydroxy alkyl having 1 to 4 carbon atoms, or (c) phenyl or benzyl which is unsubstituted or substituted by an alkyl group having 1 to 4 carbon atoms, or (2) together with the nitrogen atom to which they are bonded, are an imidazolyl or a triazolyl group; and $R_5$ is benzothiazole, a benzoxazole, benzimidazole or a cyano goup.

In a preferred embodiment, the transport compound used in the charge as transporting layer is represented by formula II

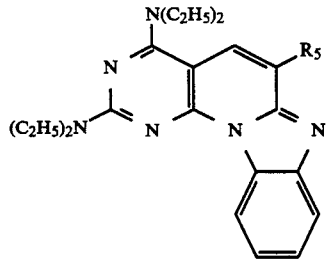

(II)

wherein $R_5$ denotes a benzothiazole or a cyano group.

Other objects, features, and advantages of the present invention will become apparent from the following detailed description. It should be understood, however, that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF PREFERRED EMBODIMENTS

Figure 1:
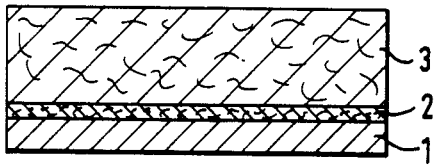
FIGS. 1–5 are schematic drawings that provide, respectively, cross-sectional views of five different recording materials within the present invention.
Figure 2:
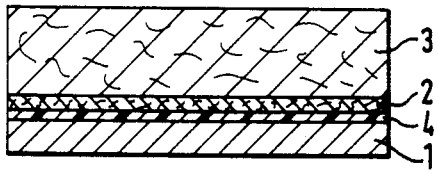

The recording material of the present invention is photosensitive not only upon positive electrostatic charging but also upon negative electrostatic charging. Its photosensitivity can also be adjusted to certain spectral regions, either on a positive or negative polarity. Depending on the application, the spectral sensitivity region can be affected very favorably, in particular by the inclusion of photoactive pigments.

Particular preference is given, in accordance with the present invention, to a recording material that is photosensitive upon positive electrostatic charging at a wavelength of 400 to 500 nm, and upon negative electrostatic charging at a wavelength of 500 to 800 nm.

The recording material of the present invention has, owing to the above-mentioned properties, many and varied uses. For instance, it is suitable for copying purposes, for microfilm coatings, for holographic recording, for optical control, for circuit elements, for printing plates and printed circuits, for reversal images and for charge image transfer processes. Since the photosensitivity of recording material according to the present invention is dependent on the polarity of the charging, it is especially in those cases when spectrally different light sources are used, such as helium/cadmium and argon lasers having a wavelength range between about 450 and 490 nm or helium/neon lasers having a wavelength range of 630 nm or LED and laser diode light sources having wavelength ranges of 660 and 790 nm, respectively, that the photosensitivity of the recording material can be adjusted to substantial advantage.

The structure of the double layer of the recording material according to the present invention is schematically explained in more detail by reference to FIGS. 1 to 5.

In each figure, component 1 is an electrically conductive base material; component 2 is a dye layer that generates charge carriers; and component 3 is a charge-transporting layer. Component 4 is an insulating intermediate layer, and component 5 is a dye layer that takes the form of a dispersion and produces charge carriers. Component 6 is a protective or covering layer that is superimposed on the photoconductive double layer.

The transport compounds used according to the present invention are, surprisingly, particularly suitable by virtue of (1) their self-absorption in film together with binders and (2) their p-conductivity in the blue spectral region. The transport compounds thus are particularly highly photosensitive upon positive electrostatic charging, and at the same time act as optical filters. Use of the compounds, pursuant to the present invention, with the sensitizing dye layers as components 2 or 5 (see FIGS. 1 to 3) has the effect of expanding the photosensitivity toward longer wavelengths. In this region their photosensitivity is then high, especially upon negative electrostatic charging.

Figure 4:
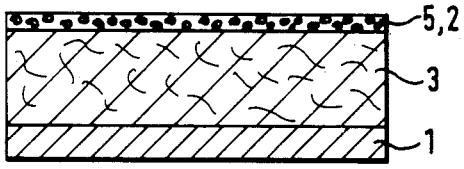
Figure 5:
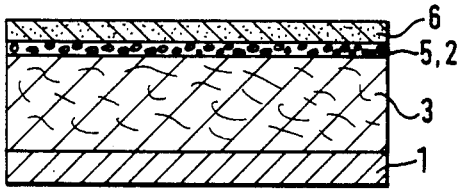

In the photoconductive double layer arrangement of the present invention, the dye layer can also be applied, as depicted in FIGS. 4 or 5, to the charge-transporting layer 3. As a result, photosensitivity upon positive charging can be expanded to include the entire spectral range.

The transport compounds used according to the present invention are generally disclosed in German Offenlegungsschrift No. 2,929,414, where their synthesis and characterization can be found. Furthermore, the transport compound represented by the formula I above can also be reacted by condensation with formaldehyde to give a polycondensate, thereby producing material having both a high photosensitivity and a good film-formation capacity.

As stated, the photoconductor layers of the recording material according to the present invention are configured in a double-layer arrangement. The simplest embodiment is produced by applying the charge-generating layer, for example, by spraying, including electrostatic spraying, or by vapor deposition in vacuo. A homogeneous sensitizer dye layer can also be obtained by applying it from solution to the conductive base material 1 and drying. The charge-transporting layer 3, which also has a charge-generating function within the wavelength region below 500 nm, can then be applied (see FIG. 1).

A second embodiment (FIG. 2) comprises an insulating intermediate layer 4 which is introduced for the purpose of improving adhesion or certain electrophotographic properties.

Figure 3:
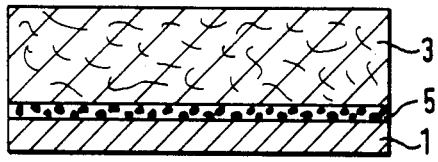

The charge-generating layer of pigments can also be applied as a dispersion layer 5 (FIG. 3). The pigment content in the binder therein is preferably above 50% by weight.

FIG. 4 depicts the inverse of the arrangement shown in FIG. 1: after application of a binder and charge-transporting layer 3 which contains the transport compound according to the present invention, a dye layer 2 or 5 is applied on top by any of several conventional application techniques. To protect this dye layer, a protective layer 6 made of organic or inorganic materials, such as SiO, can be applied (see FIG. 5).

By means of a number of binders, the charge transport compounds can be dissolved together and cast to give homogeneous films. The transport compound-to-binder mixing ratio is preferably 1:1. This ratio is limited due to crystallization of the transport compound, in the case of an excessively high concentration of photoconductor (more than 50% by weight), and by a lower photosensitivity, in the case of too low a content (less than 20% by weight) in the particular binder.

The thickness of the charge-transporting layer is not critical. It is generally within the range from 4 to 20 μm. According to use, however, these limits can be overshot or, where appropriate, even undershot. The thickness of the charge-generating layers is preferably within the range from 0.05 to 3 μm, but likewise can be adjusted up or down, according to particular use requirements.

Figure 6:
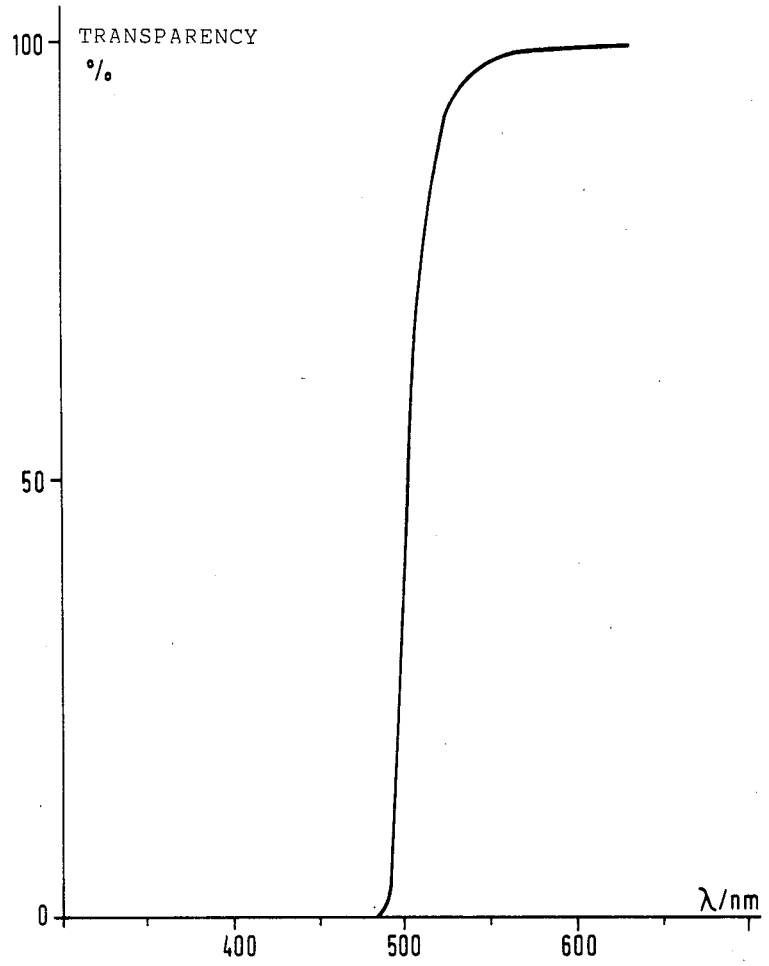
FIG. 6 is a graph showing the relationship between absorptivity (percent transparency) of compound IIa as a film and the wavelength of radiation.

The high absorptivity within the visual region up to about 500 nm of transport compounds according to the present invention is illustrated in FIG. 6.

The maximum absorption, for example, of the compound represented by formula IIa wherein $R_5$ denotes:

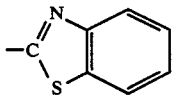

is about 431 nm, with a secondary maximum at 455 nm.

Preference is given in the present invention to the use of dyes that absorb within the region from 500 to about 800 nm. But even dyes with an absorption range from 400 to 500 nm can have a sensitivity-enhancing effect and, therefore, be used as described above.

Figure 11:
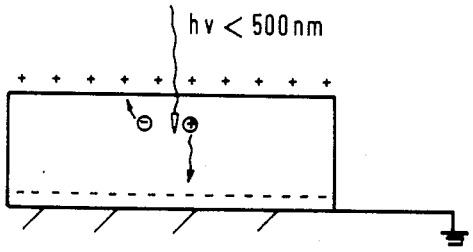
FIGS. 11 and 12 are schematic drawings illustrating a proposed mechanism for photosensitivity under positive and negative charging, respectively, of a recording material within the present invention.

The photosensitivity upon positive electrostatic charging of the transport compounds according to the present invention can be attributed to absorption, excitation and charge generation, under the influence of the electric field, involving molecules of the transport compound in an upper "excitation" zone. The extent of the excitation zone depends on the depth of penetration of the light into the photoconductive layer (see FIG. 11). The p-conductive character of these compounds (i.e., conduction by hole-formation and -transport via free radical cations) has the effect of providing better transport for the resulting defect electrons over a wider thickness range.

Figure 12:
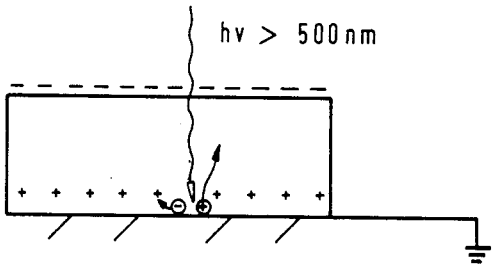

The photosensitivity upon negative electrostatic charging of recording material within the present invention can be effected by absorption and excitation of the dye molecule at which, under the influence of the electric field, the charges separate and the defect electron is injected into the adjacent, charge-transporting layer (see FIG. 12). In this context the charge-transporting layer acts as a filter for wavelengths smaller than 500 nm.

The electrically conductive base material used, in particular, for the preparation of printing forms by electrophotographic means, can be any material conventionally employed for this purpose, such as aluminum, zinc, magnesium, copper foils and plates and multimetal plates. Other possible base materials include plastics, such as polyamides in sheet form, or metallized sheets. Surface-finished aluminum foils have been found to be particularly suitable. The surface finish comprises a mechanical or electrochemical roughening and, where appropriate, a subsequent anodization and treatment with silicate or with polyvinylphosphonic acid, as described in German Offenlegungsschrift No. 1,621,478 (which corresponds to British Pat. No. 1,230,447). Also usable as a base material in copying material of the present invention are aluminum-laminated metal foils or aluminized polyester sheets, for example, transparent sheets and special papers made conductive with palladium or indium-tin oxide, for electrophotographic microfilm recording materials.

The optional insulating intermediate layer can be formed from organic synthetic resins, such as polyurethanes and the like, in the form of a thin film.

Suitable binders which are preferred by virtue of their film-forming properties and adhesive strength include natural and synthetic resins, in particular polyester resins, polycarbonates, polyurethanes, vinyl chloride/vinyl acetate copolymers, polyvinyl acetals, cellulose acetobutyrates, polystyrenes, copolymers of styrene with, for example, butadiene or acrylate esters, silicone resins, poly(meth)acrylates, cellulose nitrates, rubber and rubber derivatives such as chlororubber, cyclized rubber and the like. In addition to the film-forming and electrical properties and those properties relating to strength of adhesion to the base material, solubility properties play an important role in the selection of binders for use in printed forms and printed circuits. For practical purposes, those binders that are soluble in aqueous or alcohol solvent systems, with or without the addition of acid or alkali, are particularly suitable, i.e., the charge-transporting layer and, where appropriate, the charge-generating layer preferably contain alkali-soluble binders. Accordingly, suitable binders are therefore high-molecular substances which carry groups conferring alkali solubility. Examples of such groups are acid anhydride, carboxyl, phenol, sulfo, sulfonamide and sulfonimide.

Binders can be used alone or in combination in the present invention. Copolymers with anhydride groups can be used particularly successfully, such as copolymers of ethylene or styrene and maleic anhydride. Phenolic resins have likewise been found to be highly suitable. The alkali-soluble binder used can also be a copolymer of styrene, methacrylic acid and methacrylate ester, such as a copolymer of 1 to 35% of styrene, 10 to 40% of methacrylic acid and 35 to 83% of n-hexyl methacrylate. A terpolymer from 10% of styrene, 30% of methacrylic acid and 60% of n-hexyl methacrylate is likewise highly suitable. It is also possible to use polyvinyl acetates, in particular copolymers of vinyl acetate and crotonic acid.

To sensitize the double-layer embodiment of the present invention, a number of pigments can be used, including phthalocyanine pigments, such a copper phthalocyanine, or thioindigo, comparatively highly condensed quinone, quinacridone, perylene, anthraquinone, perinone, azo, bisaza, trisazo and cyanine pigments, benzo(-thio)xanthene derivatives (such as under formula IV), and mixtures thereof. For the charge-generating layer, blue and/or violet dyes are particularly preferred. They include metal-containing and metal-free phthalocyanine, in particular copper phthalocyanines in their various modifications; bisazo and trisa pigments; and perylimide pigments. Preference is also given to the use of condensation products of perylene-3,4,9,10-tetra-carboxylic dianhydride and aromatic diamine, such as o-phenylenediamine, for example, perylene-3,4,9,10-tetracarbdiimidebisbenzimidazoles (see formula III). (Iso)-violanthrones and dioxazine pigments can also be used.

In a further embodiment of the present invention, the charge-generating layer comprises a dye layer that is applied from homogeneous solution of one or more dyes. Suitable sensitizers in this case include: triarylmethane dyes, such as brilliant green, malachite green, victoria pure blue B, choromoxane pure blue B, methyl violet, wool fast blue FLG, crystal violet, acid violet 6BN and Fanal blue RM; xanthene dyes, namely, rhodamines and phthaleines; thiazine dyes, such as methylene blue; acridine dyes; quinoline dyes, such as pinacyanol and kryptocyanine; quinone dyes and ketone dyes; cyanine dyes (polymethine dyes), such as Astrazone orange G and R (C.I. 48,035 and 48,040). Pyrylium salts, thiapyrylium salts and benzopyrylium salts can also be used. Sensitizing dye mixtures can likewise be present.

The charge-transporting layer essentially contains the organic transport compound and binders and, as the application requires additional customary additives, such as activators, plasticizers, flow-control agents and the like.

The present invention is described in more detail by reference to the following examples.

EXAMPLE 1

The pigment N,N'-dimethylperylimide (C.I. Pigment Red 179) was carefully sublimed in vacuum of $1.33\times10^{-7}$ to $10^{-8}$ bar and at a temperature of about 290° C. onto a 100 μm thick aluminum foil to give a homogeneous, covering pigment layer having a weight of 150 to 200 mg/m$^2$.

To provide a charge-transporting layer, this charge-generating layer was overcoated with a solution containing 50 parts by weight of compound IIa and, respectively, 50 parts by weight of one of the following binders: of (1) a copolymer of vinyltoluene/acrylate (Pliolite VTAC), (2) a copolymer of styrene/butadiene (Pliolite S5B), (3) polyvinylbutyral resin (Mowital B60H), (4) polycarbonate resin (Makrolon 2405) and (5) cellulose nitrates (CN HP 25000) in tetrahydrofuran (THF). The layer thickness of the resulting layer was about 8 μm after drying for about 5 minutes at 95° C. in a through-circulation oven.

The measurement of the photosensitivity was carried out as follows: to determine the brightness discharge curves, the sample was moved on a turning support through a charging device to the exposure station, where it was continuously exposed with an XBO 150 xenon lamp or halogen W lamp (150 W). A heat absorption glass and a neutral filter had been placed in front of the lamp. The light intensity in the measurement plane was about 25 μW/cm$^2$. The charge level and the photo-induced decay curve were recorded oscillographically, using an electrometer, by means of a transparent probe. The photoconductor double layer was characterized by the charge level (Uo) and that time ($T_{\frac{1}{2}}$) at which half the charge (Uo/2) is reached. The product of $T_{\frac{1}{2}}$ and the measured light intensity I (μW/cm$^2$) is the half-life energy $E_{\frac{1}{2}}$ (μJ/cm$^2$):

| Transport layer (designated by binder) | (−) Uo(V) | $E_{\frac{1}{2}}$ |
|---|---|---|
| (1) | 590 | 2.5 |
| (2) | 790 | 2.7 |
| (3) | 700 | 3.8 |
| (4) | 830 | 2.2 |
| (5) | 650 | 4.7 |

EXAMPLE 2

To measure the transmission curve of the charge-transporting layer, a solution comprising equal parts by weight of transport compound IIa and polyvinyl butyral (Mowital B30H) in tetrahydrofuran was whirler-coated onto an optically transparent polyester sheet and then dried. The transparency (%) of the resulting layer, which was approximately 10 g/m$^2$ thick, is depicted in FIG. 6 as a function of the wavelength.

EXAMPLE 3

Metal-free phthalocyanine (C.I. 74,100, Monolite Fast Blue GS) was carefully sublimed in a vacuum of $1.33\times10^{-7}$ to $10^{-8}$ bar and at a temperature of about 260° C. onto an aluminized polyester sheet to give a homogeneous, continuous, vapor-deposited pigment layer having a weight of 170 mg/m$^2$. The blue vapor-deposited layer was then overcoated with a tetrahydrofuran solution comprising equal parts by weight of transport compound IIa and polyvinylbutyral resin (Mowital B30H) to a thickness of 2 to 3 and 8 to 9 μm, respectively.

The photosensitivity was measured as in EXAMPLE 1:

| Thickness (μm) | (−) Uo(V) | $E_{\frac{1}{2}}$ | (+) Uo(V) | $E_{\frac{1}{2}}$ |
|---|---|---|---|---|
| 2 to 3 | 300 | 2.9 | 470 | 9.6 |
| 8 to 9 | 810 | 5.8 | 830 | 13.8 |

The spectral photosensitivity of the thicker photoconductor layer was determined by the method indicated in Example 1, using interposed interference filters:

Using negative or positive charging (800 to 850 V), the half-life ($T_{\frac{1}{2}}$ in msec) was determined for the respective wavelength regions by exposure. Plotting the reciprocal half-life energy [$1/E_{\frac{1}{2}}$(cm$^2$/μJ)] against the wavelength λ in nm gives the spectral photosensitivity curve. This half-life energy $E_{\frac{1}{2}}$ (μJ/cm$^2$) is that light energy which must be incident in order to discharge the layer to half the initial voltage Uo.

Figure 7:
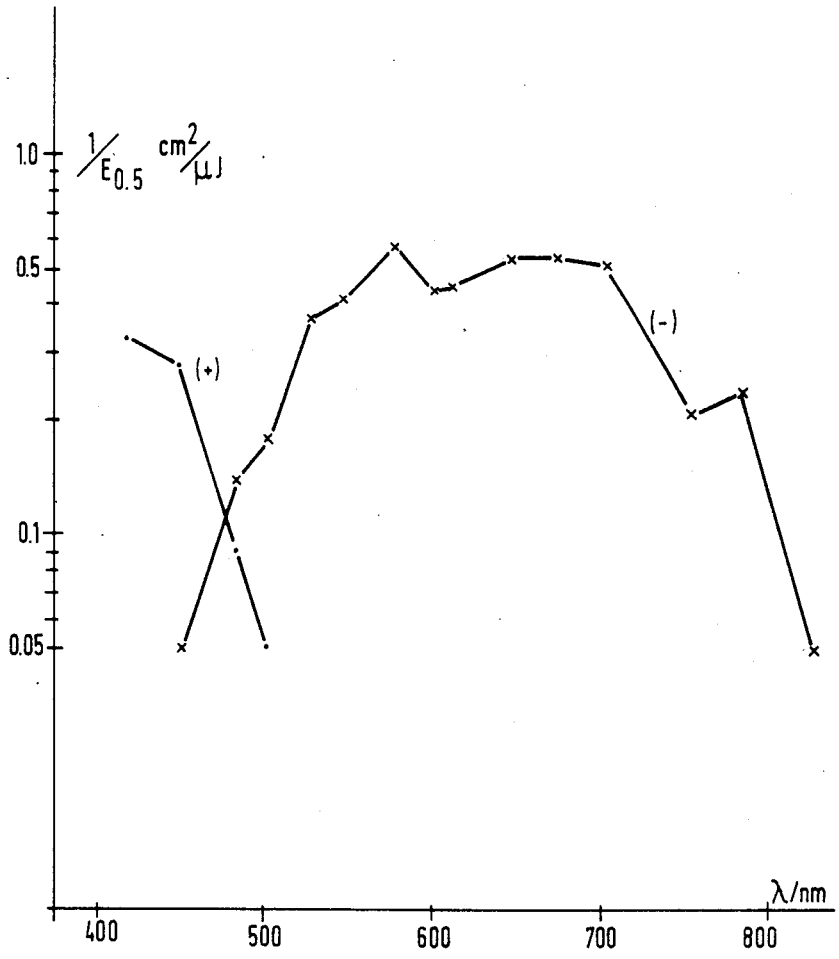
FIGS. 7–10 are each graphs that depict the spectral photosensitivity of photoconductive double-layered recording material.

FIG. 7 shows a plot of the spectral photosensitivities of the photoconductor double layer upon positive and negative charging (about (+) 780 and (−) 700 V, respectively.

EXAMPLE 4

Analogously to Example 1, a charge-generating layer was overcoated with a solution containing equal parts by weight of (i) the transport compound represented by formula IIb when $R_5$ is —CN and (ii) binder selected from (a) polyester resin (Dynapol L 206) and (b) cellulose nitrate (CN HP 25000), respectively, in tetrahydrofuran. After drying, the layer thickness was in each case 5 to 6 μm.

Measurement of the photosensitivity as described in Example 1 provided the following results:

| Transport Layer (designated by binder) | (−) Uo(V) | $E_{\frac{1}{2}}$ |
|---|---|---|
| a | 825 | 7.05 |
| b | 500 | 7.35 |

EXAMPLE 5

A homogeneous, vapor-deposited pigment layer of perylene-3,4,9,10-tetracarbdiimidebisbenzimidazole (Formula III) was applied in a thickness of about 150 mg/m$^2$ to an aluminized polyester sheet and was overcoated with a solution containing equal parts by weight of a compound IIa and a copolymer of styrene/acrylate ester (polystyrene B) in tetrahydrofuran. The overcoated layer was then dried. In the same way a layer of a benzothioxanthene derivative (Formula IV), which layer had a thickness of about 200 mg/m$^2$, was homogeneously vapor-deposited and homogeneously overcoated with the same solution.

After drying, the layer thicknesses were in each case about 8 μm.

Photosensitivity measurement in accordance with Example 1 was:

| Pigment | (−) $U_o$(V) | $E_{\frac{1}{2}}$ |
|---|---|---|
| III | 610 | 2.7 |
| | 400 | 2.7 (~5 μm) |
| IV | 700 | 5.4 |
| | 640 | 4.7 (~5 μm) |

Figure 8:
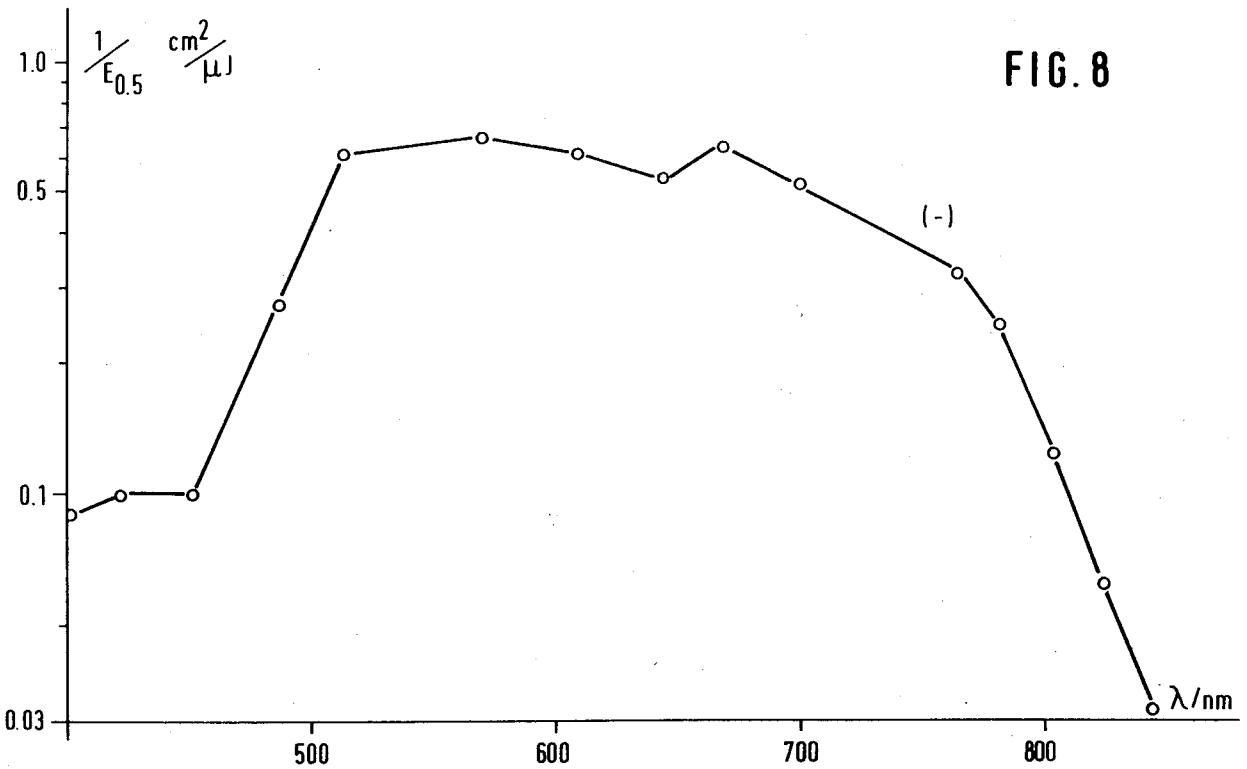

The photoconductor double layer containing pigment represented by Formula III (8 μm, charging (−) 590 V) had its spectral photosensitivity measured as indicated in Example 3 using a halogen W lamp (see FIG. 8).

EXAMPLE 6

Figure 9:
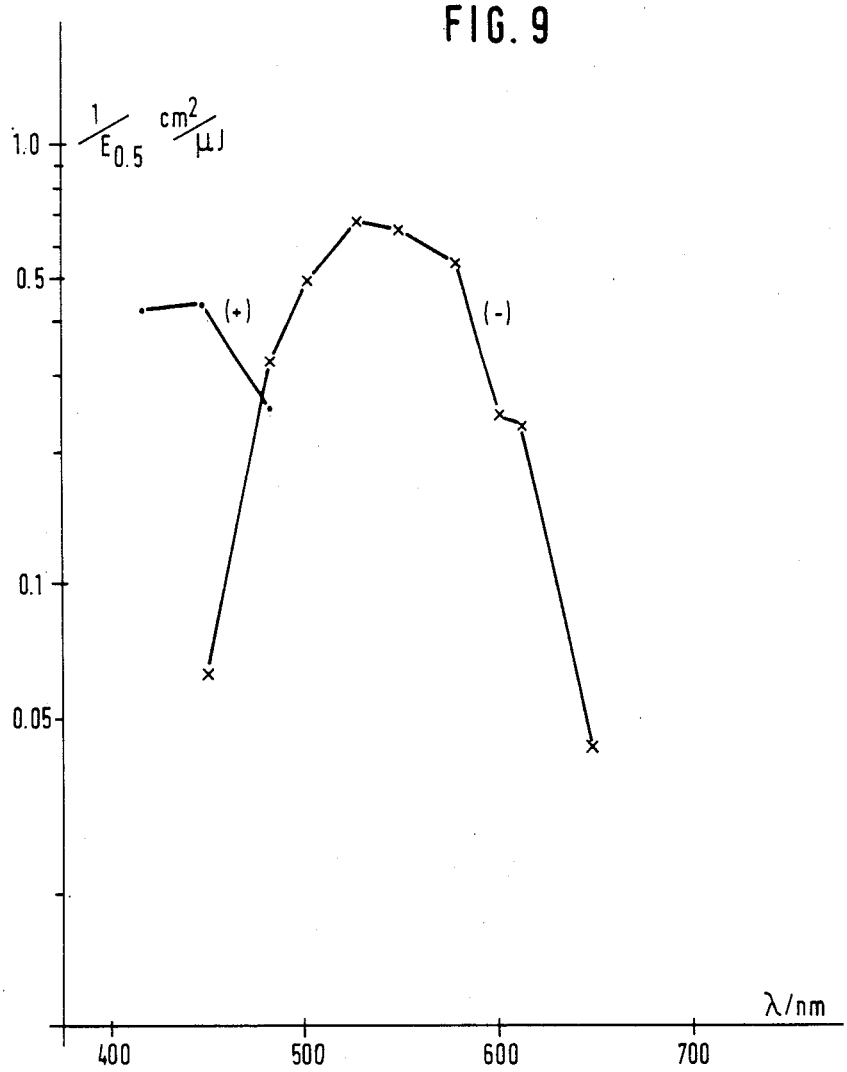

A vapor deposited pigment layer was prepared, as described in Example 1, on an aluminum base material and was overcoated with a solution containing equal parts by weight of transport compound IIa and polyvinyl butyral resin (Mowital B30H) in tetrahydrofuran. The layer thickness after drying was about 10 g/m$^2$. The measured spectral photosensitivity, upon positive and negative charging within the range from 780 to 830 V, is shown in FIG. 9; measurement was done as in Example 3, while photosensitivity was measured in accordance with Example 1:

(+) 830 V $E_{\frac{1}{2}}$~12.3 /μJ/cm$^2$ (−) 835 V $E_{\frac{1}{2}}$~5.3 μJ/cm$^2$

EXAMPLE 7

A solution containing equal parts by weight of transport compound IIa and polyvinylbutyral resin (Mowital B30H) in tetrahydrofuran was homogeneously applied to an aluminized polyester sheet in dry layer thickness of about 8.0 g/m$^2$. A pigment layer was sublimed on top, as described in Example 1, to a thickness of about 180 mg/m$^2$ (see FIG. 4).

Measurement of the photosensitivity of this inverse arrangement gave the following values upon positive charging:

(+) 680 V and $E_{\frac{1}{2}}$~10.6 μJ/cm$^2$.

Without the vapor-deposited pigment layer:

(+) 640 V and $E_{\frac{1}{2}}$~12.0 μJ/cm$^2$.

Figure 10:
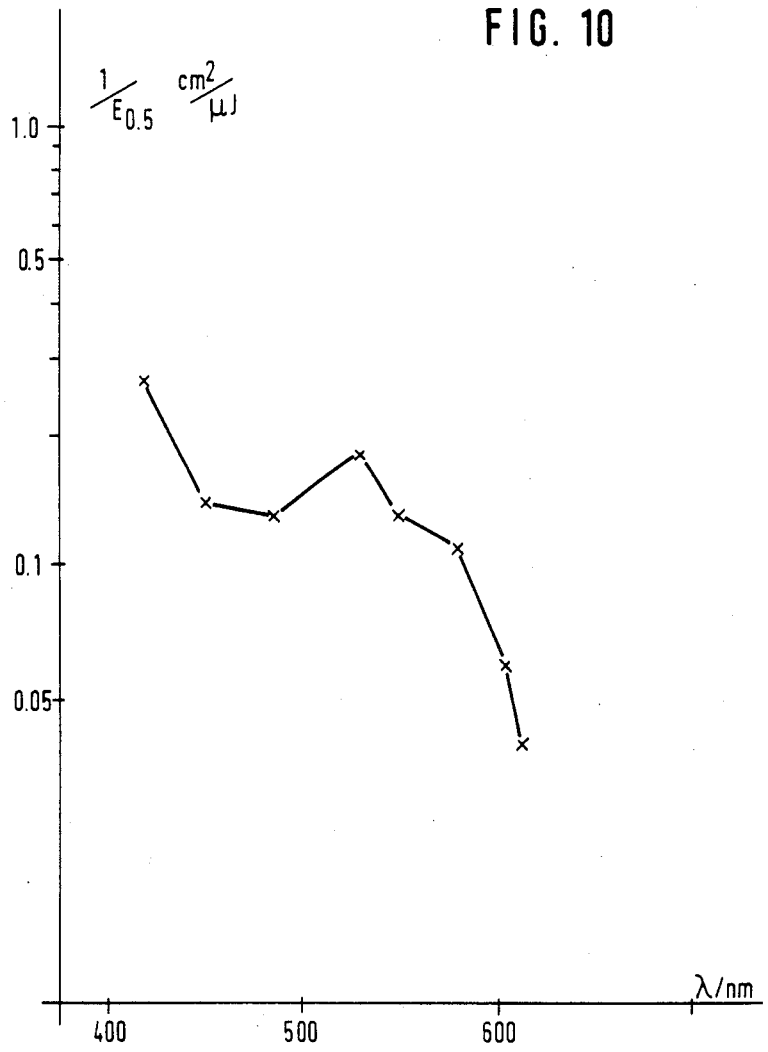

The spectral photosensitivity of the inverse arrangement upon positive charging (about 800 V) is shown in FIG. 10. In addition, this arrangement was coated in a thickness of about 5 g/m$^2$ with silicon monoxide by vacuum vapor deposition (FIG. 5). The electrophotographic properties were not changed.

What is claimed is:

1. An electrophotographic recording material comprising an electically conductive support and a photoconductive double layer provided on said support, said photoconductive double layer comprising (i) a charge-generating and (ii) a charge-transporting layer containing a pyrimido-[5',4':5,6]-pyrido-[1,2-a]-benzimidazole transport compound, a binder and a dye or pigment sensitizer, said transport compound being present in an amount ranging from about 20 to 50% by weight, relative to the admixture of binder and transport compound, wherein said transport compound is represented by the formula I

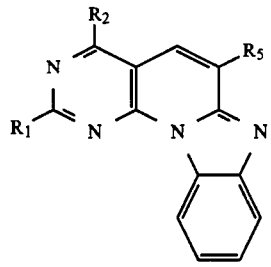

(I)

wherein $R_1$ and $R_2$ are identical or different and are each hydrogen or an $R_{3R4N}$ group, $R_3$ and $R_4$ are identical or different and (1) are each (a) alkyl having 1 to 4 carbon atoms, (b) hydroxyl alkyl having 1 to 4 carbon atoms, or (c) phenyl or benzyl which is unsubstituted or substituted by an alkyl group having 1 to 4 carbon atoms, or (2) together with the nitrogen atom to which they are bonded, are an imidazolyl or a triazolyl group; and $R_5$ is benzothiazole, a benzoxazole, benzimidazole or a cyano group.

2. An electrophotographic recording material as claimed in claim 1, further comprising an insulating intermediate layer interposed said support and said photoconductive double layer.

3. A recording material as claimed in claim 1, wherein said transport compound is represented by the formula II

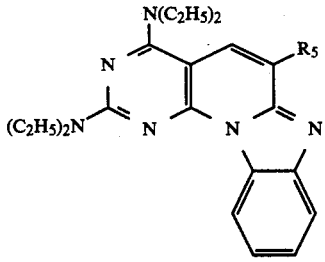

(II)

wherein $R_5$ denotes a substituent selected from the group consisting of benzothiazole and a cyano group.

4. A recording material as claimed in claim 1, said material being photosensitive, upon positive electrostatic charging, in the spectral range between about 400 and 500 nm and, on negative electrostatic charging, in the spectral range between about 500 and 800 nm.

5. A recording material as claimed in claim 1, wherein said charge-generating layer contains at least one dye selected from the group consisting of a blue dye and a violet dye.

6. A recording material as claimed in claim 5, wherein said dye comprises a compound selected from the group consisting of a metal-containing phthalocyanine and a metal-free phthalocyanine.

7. A recording material as claimed in claim 5, wherein said dye comprise a condensation product of perylene-3,4,9,10-tetracarboxylicdianhydride and an aromatic diamine.

8. A recording material as claimed in claim 1, wherein said charge-generating layer comprises a dye layer which is the product of a process comprising the step of applying to one of said support and said charge-transport layer a homogeneous solution containing at least one dye.

9. A recording material as claimed in claim 1, wherein said charge-transporting layer contains an alkali-soluble binder.

10. A recording material as claimed in claim 9, wherein said charge-generating layer contains an alkali-soluble binder.

11. A recording material as claimed in claim 9, wherein said alkali-soluble binder comprises a copolymer of styrene with one selected from the group consisting of maleic anhydride, a copolymer of vinyl acetate with crotonic acid, and a phenolic resin.

12. A recording material as claimed in claim 10, wherein said alkali-soluble binder comprises a copolymer of styrene with one selected from the group consisting of maleic anhydride, a copolymer of vinyl acetate with crotonic acid, and a phenolic resin.

13. A recording material as claimed in claim 1, wherein said charge-generating layer has a thickness of about 0.05 to 3 μm and said charge-transporting layer has a thickness of about 4 to 20 μm.

* * * * *